US007471199B2

(12) United States Patent
Zimmerman et al.

(10) Patent No.: US 7,471,199 B2
(45) Date of Patent: Dec. 30, 2008

(54) MOBILE KEY USING READ/WRITE RFID TAG

(75) Inventors: Timothy M. Zimmerman, Waxhaw, NC (US); Timothy Shane Downs Mullen, Cedar Rapids, IA (US); James Seely, Cedar Rapids, IA (US); Jeffrey Scott Roush, Cedar Rapids, IA (US)

(73) Assignee: Intermec IP Corp., Woodland Hills, CA (US)

( * ) Notice: Subject to any disclaimer, the term of this patent is extended or adjusted under 35 U.S.C. 154(b) by 46 days.

(21) Appl. No.: 11/033,067

(22) Filed: Jan. 10, 2005

(65) Prior Publication Data

US 2005/0242921 A1 Nov. 3, 2005

Related U.S. Application Data

(60) Provisional application No. 60/535,323, filed on Jan. 9, 2004.

(51) Int. Cl.
*G08B 13/14* (2006.01)

(52) U.S. Cl. ..... 340/572.1; 340/539.1; 340/539.11; 340/539.23; 340/825.69; 340/5.2; 340/5.8; 340/10.1

(58) Field of Classification Search ..... 340/572.1, 340/572.4, 539.1, 539.11, 539.23, 825.69, 340/5.1, 5.2, 5.8, 10.1, 10.3; 235/375, 376, 235/383, 385

See application file for complete search history.

(56) References Cited

U.S. PATENT DOCUMENTS

| | | | | |
|---|---|---|---|---|
| 5,629,981 | A * | 5/1997 | Nerlikar | 713/168 |
| 6,611,198 | B1 * | 8/2003 | Geiszler et al. | 340/10.41 |
| 7,069,251 | B1 * | 6/2006 | Bartz et al. | 705/75 |
| 2003/0167207 | A1 * | 9/2003 | Berardi et al. | |
| 2005/0040952 | A1 * | 2/2005 | Dearing et al. | |

* cited by examiner

*Primary Examiner*—Hung T. Nguyen
(74) *Attorney, Agent, or Firm*—O'Melveny & Meyers LLP

(57) ABSTRACT

A mobile key includes an RFID tag associated with a memory. The memory holds a secure access code. An authorization status for a person or item associated with the mobile key is determined by interrogating the mobile key using an RFID interrogation field. Security information, such as a secure identifier or access code, physical measurement data, or biometric data may be provided by the mobile key. The key may also comprise a wireless communication device, such as a cellular telephone. Security information, such as an access code, may be provided to the key using the wireless communication device or other communications network.

44 Claims, 7 Drawing Sheets

MOBILE KEY USING READ/WRITE RFID TAG

CROSS-REFERENCE TO RELATED APPLICATION

This application claims priority pursuant to 35 U.S.C. § 119(e) to U.S. Provisional Application No. 60/535,323, filed Jan. 9, 2004, which application is specifically incorporated herein, in its entirety, by reference.

BACKGROUND OF THE INVENTION

1. Field of the Invention

The present invention relates to security keys, for example key cards and magnetic badges, and methods for using them.

2. Description of Related Art

Keys, cards, or tickets with encoded secure access information are increasingly used to secure access to facilities, materials and equipment, and at the point of payment or delivery for commercial transactions. Such keys often comprise a physical article, such as a badge or ticket, that includes a secure access code in a magnetic or optical form. The keys are encoded with a secure access code using a suitable encoding device, such as a magnetic writing device. Often, the access code is encrypted for greater security. The access code is stored in a database and the physical key is distributed to the authorized user. At the point of access control to the facility or equipment, a key reader reads the encoded secure access code, decrypts it if necessary, and compares it to a database of access codes. An appropriate level of access may then be determined based on the comparison.

Such keys may be used to grant access to a location, materials or equipment for an indeterminate amount of time, for a determined period of time or for a defined amount of use, or for a defined number of visits. For example, a key card for access to a building or secured facility are commonly used in access control systems. A single-use ticket for access to a specific event may also be considered as a type of key, when the ticket is authenticated using a secure code carried by the ticket. Further applications for keys using secure access codes may include debit cards for various purposes, such as fare cards for rapid transit, video arcades, self-service laundromats, and other automated or semi-automated vending applications. In addition to bearing an identification code, some types of debit cards may be used to keep track of an account balance. All of these applications may be considered applications of access control systems using secure access codes.

Such access control systems are subject to certain limitations. For one, encoding a new key, or updating information on an existing key, requires that the card be returned to a suitable encoding device. This may make it difficult to provide an access control system that that can rapidly adjust to changed circumstances, or that can service users lacking access to a secure encoding device. In addition, both encoding devices and key readers should be connected to a common database to ensure timely communication of current access codes and to disable invalid or expired codes. Providing such connections may sometimes be undesirably time-consuming or expensive.

It is desirable, therefore, to provide a secure access control system that overcomes the limitations of the prior art. It is further desirable to provide new applications for access control systems, that take advantage of improvements from overcoming limitations of the prior art.

SUMMARY OF THE INVENTION

The invention provides an access control system that overcomes the limitations of the prior art. According to an embodiment of the invention, at least one radio-frequency identification ("RFID") transponder ("tag") integrated circuit ("IC") capable of writing information to a non-volatile memory, and recovering information from the non-volatile memory (a "read/write RFID tag") is incorporated into secure keys of an access control system.

The invention may be used for security control applications, as well as electronic transaction control and verification applications. Transactions in industrial applications may include, for example, security control applications in which mobile workers with a cell phone, PDA (personal digital assistant) or data collection device receive an entry code that is transmitted to the device to allow access to an area within a defined period, e.g., to a restricted area such as an armory or hazardous chemical storage area.

Read/write RFID tags provide various advantages for identification applications. These advantages may include, for example, the ability to wirelessly receive and transmit data in a compact lightweight device, with or without a power source connected to the tag. Passive RFID tags are particularly well suited for applications in which the tag is to remain dormant until it is placed in proximity to a reader/interrogator device that excites the RFID tag at the proper frequency. A further advantage may comprise the ability to more readily update data stored in a non-volatile memory on the tag. Using various encryption/decryption methods as known in the art, data stored in the RFID tag may be stored in a secure form.

In an embodiment of the invention, RFID technology is combined with longer-range wireless communications technology to provide a programmable flexible mobile key. Suitable longer-range wireless communications technology may include, for example, wireless local area communication or wireless wide area communications such as used for cellular, PCS, and satellite wireless communication signals, both analog and digital, wireless local area networks, and the like. The mobile key may incorporate, for example, any suitable long-range wireless communication device, an RFID device incorporating or connected to a memory, and an interface between the long-range wireless communication device and the RFID device. In addition, or in the alternative, the mobile key may be configured to dock with a wired network, for example the Internet or a local area network.

The mobile key may be used for various access control applications, for example, to authorize single or multiple-use entry into secure locations. Using the combined wireless/RFID device, an encrypted access code may be received through cellular voice or data communication infrastructures, and then stored in an RFID receiving chip embedded in the cellular phone, PDA, or other wireless receiver. When the wireless/RFID device is close to an access control device for the desired application, a reader/interrogator excites the RFID chip at a predetermined frequency. The RFID chip transmits the access code to the reader/interrogator, which in conjunction with a secure access control application, decrypts the access code and determines whether or to what extent access is allowed through the access control device.

Advantageously, the combined wireless/RFID mobile key may be controlled anywhere within the coverage area of its wireless network. Such control may be accomplished by sending encrypted information to a control unit in the mobile key, using a wireless communication signal and the wireless communications component of the mobile key. The control unit is configured to communicate with the RFID chip, or with a memory connected to the RFID chip, so as to securely modify or replace stored information. For example, a wireless signal may be used to transmit a new access code, a command to delete a past access code from the RFID memory, an account balance, biometric data, identity data, or any combination of the foregoing.

In an alternative embodiment, the mobile key is not equipped with a long-range wireless communication device. Instead, the RFID device is used as the only wireless communication device on the mobile key. Currently, passive RFID devices are capable of communicating with a base station up to a distance of about six feet from a base station (i.e., interrogator/reader) antenna; with battery-powered RFID devices this range may be extended somewhat. Although presently-available RFID technology is not capable of wireless communication over a wide geographic area, for many applications, antennas for an RFID base station may be placed so as to cover a desired communication area. For example, antennas may be placed to cover all or any desired portion of a room, floor, building, vehicle, or campus.

Communications with the mobile key may be tailored to the intended application by selection and placement of base station antennas. Different functions may be performed by different antennas within a system. For example, an RFID antenna at a point of entry may be used to read an access code and "check-in" the key holder, while an RFID antenna at a separate exit may be used to "check-out" the key holder, during or after a predetermined period of accessibility.

Whether or not the mobile key incorporates a longer-range wireless communication device, the ability to update the RFID memory as desired over virtually any area of interest enables a myriad of new capabilities and uses for the mobile key. To name just a few, a new access code may be required after each use, or after a defined period of time, for access to the same facility. Multiple access codes may be supplied for access to different resources. A user's authorization status with respect to a particular area may be remotely updated. One or multiple account balances may be remotely updated for use in combined identification/debit card applications. User identity information may be remotely updated, including biometric data.

For example, a mobile key and access control system according to the invention may be used as an electronic ticket for admission to paid events such as movies, concerts, and amusement parks. Current systems may provide the ability to purchase movie tickets over the Internet or purchase them at a kiosk at the movie theater. This same transaction may be performed without the kiosk anywhere there is wireless communication coverage, by providing a transaction confirmation code to an RFID chip using a base station or longer-range wireless communication signal. Once payment is made, which could be in person, or using any remote communication device, an encrypted or non-encrypted access code may be sent to the mobile key designated by the purchaser, and stored in the RFID chip embedded in the key. As the user approaches an RFID reader at an access control device for the event, the reader excites the chip to respond with the access code, which is supplied to system controller. Access may then be permitted through an access control device to the bearer of the mobile key, with or without further confirmation of the user's identity.

In the alternative, access may be granted based on an identifier of the mobile key read by an RFID reader at an access control zone, in conjunction with a separate access control database. In this alternative embodiment, the access control database is used to record the authorized access level for the holder of the designated mobile key, which merely serves as an identification device. This alternative requires that the access to the database be provided at the access control device, which may not be desirable in all applications.

The mobile key may be used as a debit card to maintain an account balance. For example, in an vending application a user may use any communication method, for example, a telephone or the Internet, to purchase credits for use with vending terminals, for example, vending machines or gaming terminals. An updated credit amount is then provided to the mobile key via a wireless communication or RFID signal, and stored in a memory. Prior to a vending transaction, the account balance is read and updated using an RFID system associated with the vending terminal.

Mobile keys according to the invention may also be used to store biometric data or other identifying information associated with an individual user. The mobile key is then available for use as a secure identification card, lessening or even eliminating the need to confirm the key-holder's identity by some other method, while enabling the same key to be used with different individuals or multiple individuals at the same time. For example, fingerprint, retinal scan, voice ID, genetic, or other personal information may be encrypted and stored in a memory accessible to an RFID chip in the mobile key. This information may be updated as needed, and may pertain to a single individual, or multiple individuals. As the key holder approaches a control point, the encrypted biometric data is transmitted to an identity verification system at the control point. The system also includes a suitable biometric data input device, for example, a microphone, fingerprint sensor, digital camera, or the like. Biometric data as read at the control point is compared to the data stored on the mobile key, and the key-holder's identity is confirmed by a match.

Similarly, an RFID device may be attached to a physical package, and used to document security information relating to the package, for example, its contents, size, weight and origin and chain-of-possession. The security information may be encrypted and stored using an RFID chip attached to the package. This information may be updated as desired using authorized RFID readers/interrogators along the way. At the destination or at any other desired point of transit, the stored security information may be compared against measured package information. For example, when a package is completed at a trusted origin, its volume and weight may be measured and stored using an attached RFID chip. At points of transit along the way, the volume and measurement may be measured again and compared with the stored measurement data. Any packages with anomalies between measured and stored data may be segregated for inspection, such as to check for tampering or damage in transit.

Multiple codes can be stored in the same tag by using application or event identifiers that are carried by the mobile key with corresponding access codes, account balances, or biometric data. Thus, the mobile key may be used for access to multiple different events or applications, or by multiple persons within an authorized group. In general, the use of a memory and connected RFID device should permit a wide variety of different identification, access, and debit functions to be performed by a single key.

An RFID system according to the invention may also be configured to track the location of a key-holder over a facility. For example, in a child care center application, an alert may be provided to a facility operator if a mobile key approaches an exit or restricted area. If a second authorized key is in the same area, for example, a key belonging to a care provider or parent, this information may also be provided to a facility operator. The authorized second key may be used to, in effect, check-in or check-out a holder of the first mobile key.

A more complete understanding of the mobile key using a read/write RFID tag will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a method and system for a mobile key incorporating an RFID device, that overcomes the limitations of the prior art. In the detailed description that follows, like numerals are used to indicate like elements appearing in one or more of the figures.

Figure 1:
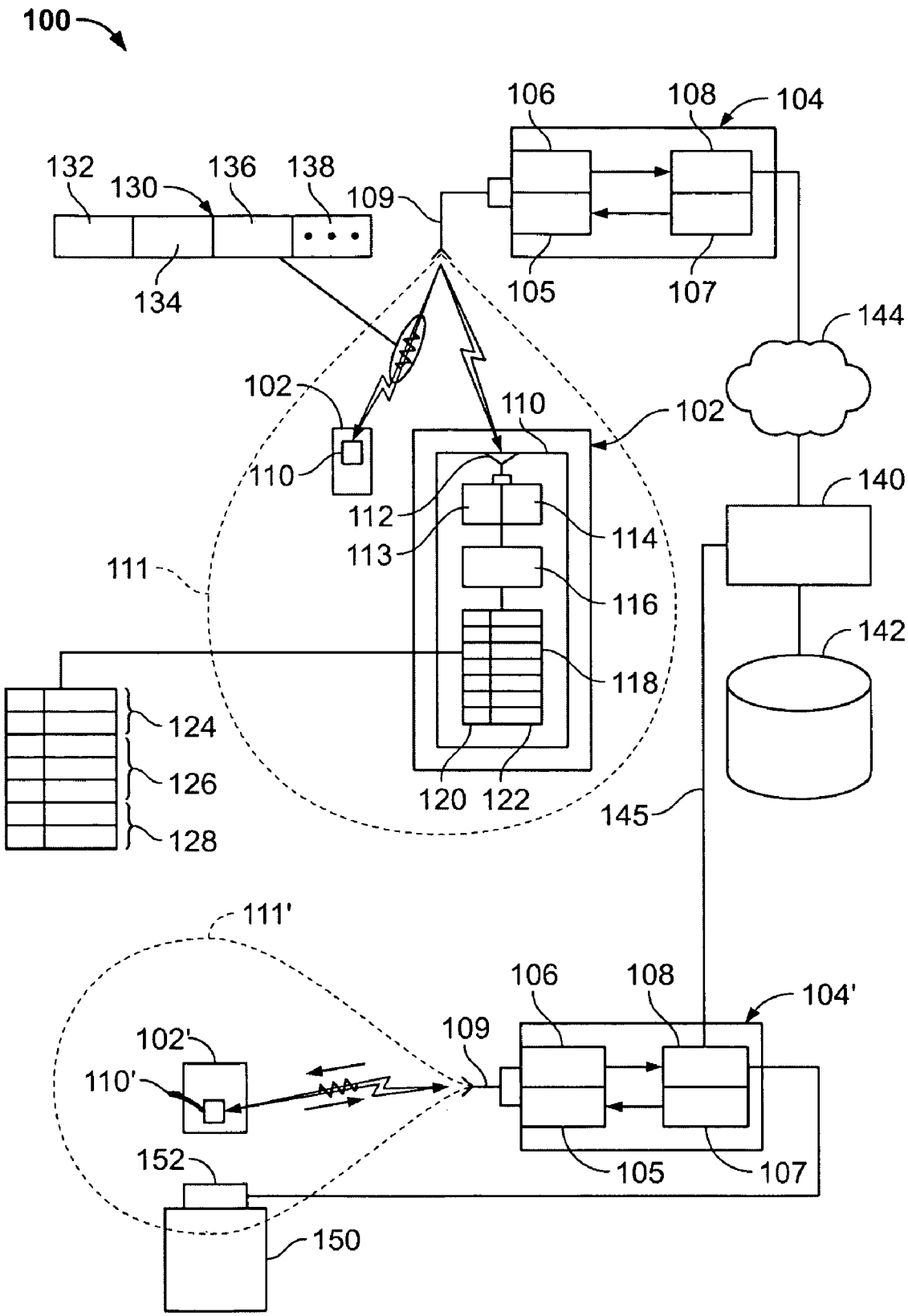
FIG. 1 is a schematic diagram showing an exemplary system including a mobile key with an RFID device component.

Referring to FIG. 1, an access control system 100 includes a plurality of mobile keys 102, 102' each incorporating at least one RFID device 110, 110'. The RFID devices 110, 110' may comprise a passive type with read and write capability. A passive RFID device is free of any battery, which may increase reliability and ease of maintenance for mobile keys 110, 110'. In the alternative, each RFID device, or some RFID devices, may be supplied with a dedicated battery (not shown), as known in the art for active RFID devices.

Access control system 100 may also include base stations 104, 104', and a central controller 140 connected to a database 142 of security information. Controller 140 may communicate with base stations 104, 104' via a network 144 or by a direct connection 145. Communications between the controller and the base stations may be secured using any suitable method, as known in the art. Base stations 104, 104' may comprise components as known in the art, for example, RFID antenna 109, receiver 105, transmitter 106, and a computer 108. Computer 108 may operate various processes performed by the base station, including, for example, a write process 107. Base station 104 may be configured to communicate with RFID devices 110 within range (i.e., within an effective region of an interrogation field 111) of antenna 109. In particular, base station 104 writes access control information, e.g., an access code, to a memory 118 of an authorized RFID device.

Access control information may be transmitted using one or more data packets 130. RFID device 110 may comprise other components as known in the art, for example, antenna 112, transmitter 113, receiver 114, and logic registers 116. Memory 118 may comprise data addresses 120 and data locations 122. Memory 118 may be divided into any number of blocks, e.g., memory blocks 124, 126, 128, allocated for specific data. For example, block 124 may be allocated for RFID tag identification data, block 126 for access control data such as one or more access codes for one or more resources or events, and block 128 for other information. Other information may comprise, for example, an account balance or transaction ledger, personal or other identifying information, biometric data, other measurement data, or a history of use for the mobile key. As known in the art, memory 118 should be non-volatile so as to retain data when the RFID device is not powered. It should be appreciated that RFID chip may comprise other memory, for example, logic registers 116, of a volatile nature.

Authorization for writing the access control information may be obtained from controller 140 using database 142. In addition, or in the alternative, computer 108 of base station 104 or another controller 140 may grant authorization for release of an access code, after communicating with an RFID device of a mobile key 102 and/or receiving other input, e.g., via a keyboard, touch-tone input, or magnetic card reader.

After access control information has been stored in a memory 118 of an RFID chip 110, the chip may be interrogated via its antenna 112 when placed in an interrogation field of a base station controlling access to an area or other resource. For example, base station 104' via antenna 109 provides an interrogation field 111' for an access control device 152 (e.g., a turnstile, door, vending machine, or transaction terminal) for resource 150. When mobile key 102' is placed in interrogation field 111', RFID device 110' is activated and provides the access code to computer 108 via receiver 105. In the case of a passive RFID chip 110', power for operating the chip is obtained from the interrogating field 111' of base station 104'. Computer 108 authenticates the access code, for example, by communicating with a secure database controller 140. If the access code supplied by the RFID device 110' is valid, computer 152 unlocks the access control device 152, permitting access to resource 150 to a bearer of mobile key 102'. If the access code is not valid, the access control device is not unlocked and the key holder may be instructed to leave the area. It should be appreciated that validation of an access code may involve other factors, such as date and time-of-day, that may also be checked before access to the resource is permitted.

In an embodiment of the invention, interrogation field 111' is configured so as to contain only one party at a time seeking access to resource 150. In an alternative embodiment, more than one access event (e.g., several people at once) may be authorized based on the access information from a single mobile key 110'. In such case, a controlled entry of several persons may be accomplished via a turnstile or the like, or the authorized number may be communicated by the base station 104' to an attendant, e.g., by a visual display. More generally, however, interrogation field 111 (i.e., the field used for writing security data) and interrogation field 111' (the field used for reading data at an access control device) may both be configured to accommodate the presence of several different mobile keys in the interrogation field at once. In such case, the system should be configured so that secure access control data is only written to the intended mobile key or keys. Likewise, the system should be configured to read and separately handle secure data from multiple keys present in an interrogation field.

For example, security access information 130 received by RFID chip 110 may be formatted as shown at packet 130 of FIG. 1. Packet 130 comprises a write broadcast command 132, sent data 134, i.e. the access control information, and a sent address 136 that identifies the targeted RFID chip and/or memory location where the data is to be stored. A later portion of the packet may comprise additional pairs 138 of sent data and sent addresses. RFID devices compatible with system 100 may be configured to only store data addressed specifically to them, and to ignore other information. To prevent theft of security information by a rogue device, communications with RFID devices should be encrypted as known in the art. Address data and other data may be encrypted. Further details concerning communicating with RFID devices may be as known in the art, for example, as described in U.S. Pat. No. 5,942,987 and later in this specification.

Figure 2:
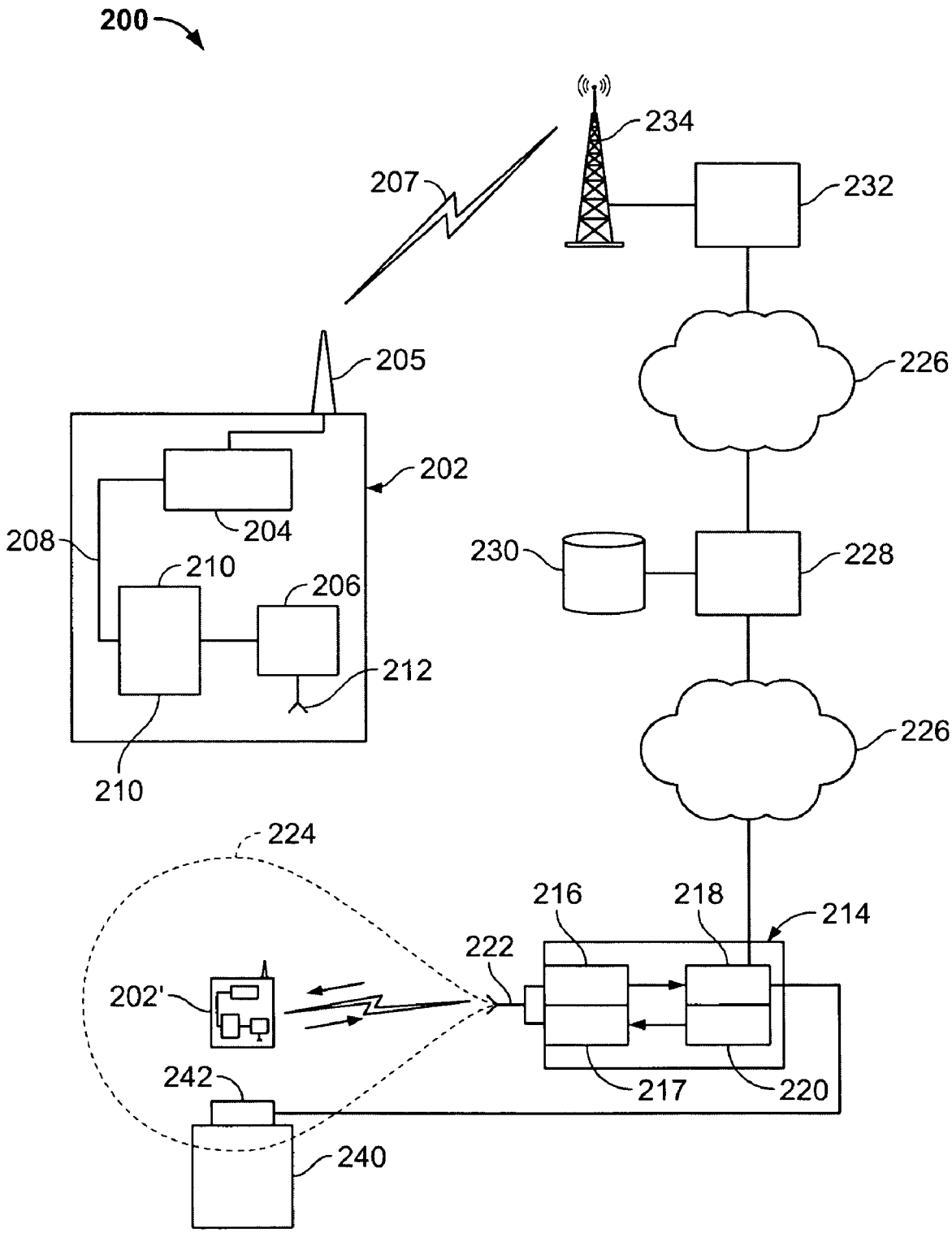
FIG. 2 is a schematic diagram showing an exemplary system including a portable wireless device equipped with a passive RFID chip.

Referring to FIG. 2, a portable wireless device 202 comprises an antenna 205 for receiving data such as access control information in either an encrypted or non-encrypted format via a wireless transmission such as indicated at 207. The wireless device may include mobile telephone or other network communication circuitry 204 connected to the antenna 205, and to an incorporated RFID chip 206. RFID device 206 may also be connected to a separate antenna 212 for shorter-range communication according to known RFID standards. More generally, antenna 205 may receive security access information via a wireless wide area communications network and/or a wireless local area communications network. Wireless signals 207 may originate from one or more terrestrial antennas 234, from an orbiting satellite transmitter, or other signal source configured to transmit over a geographical region. Communication device 202 may also be configured to operate as a mobile telephone for voice and other data, as known in the art. A suitable RFID chip for use with mobile key 202 is described below in connection with FIGS. 7 and 8. Various other designs may also be suitable.

In addition, or in the alternative, device 202 may be equipped to communicate via a wired connection to a network. In such case, the device 202 may be equipped with a suitable connector for making a wired connection, for example, an Ethernet or serial connector. Device 202 may be docked periodically with a network terminal to communicate via the network when it is not being used as a mobile device.

In an embodiment of the invention, a mobile phone battery (not shown) may supply operating voltages to the RFID chip 206 during writing of the access control information to a non-volatile memory of the RFID chip. Referring again to FIG. 2, a communication bus 208 may provide received security access information from the cell phone circuitry 204 to a memory of chip 206 via a suitable memory interface circuit 210. Mobile key 202 may then be presented to an RFID base station for access to a resource 240.

For example, mobile key 202' is presented within interrogation field 224 of base station 214 for access to resource 240 via access control device 242. Base station 214 may comprise an antenna 222 connected to receiver 216 and transmitter 217, which are operated by a computer 218 running various processes such as a read process 220. Base station 218 may read security data from a RFID tag of mobile key 202', and consult a database of security information 230 for control of access to resource 240 using device 242. Base station 218 may be connected to database 230 via a network 226 and remote host 228, or via any other suitable connection as known in the art.

In an embodiment of the invention, mobile phone power may be applied to interface 210 when access control data has been received by mobile circuitry 204 and is ready to be stored in a memory of RFID device 206. Interface 210 may then supply the necessary operating power to the antenna pads. Access control information received by the cell phone circuitry 204 may be formatted to correspond to a normal command to the RFID chip 206. For example, a write-broadcast command as shown and described in connection with FIG. 1 above may be supplied to interface 210. Interface 210 may then supply the command to the RFID device 206, e.g., to an address/data decoder of the device. The address/data decoder may communicate decoded address and data information to a tag state machine, which records sent data as appropriate in a tag memory. That is, as far as the RFID device is concerned, data from interface 210 may be treated in the same way as data from the RFID tag's internal receiver connected to antenna 212. Further details concerning internal operations and structure of RFID devices may be as known in the art, for example, as described in U.S. Pat. No. 5,942,987 and later in this specification.

To avoid use of an additional input/output pin on the RFID device 206, the chip could be designed to utilize existing input/output pins provided for testing during wafer sort. For example, it is known in the art to provide bidirectional digital and analog I/O pads for use in wafer sort operations. Such pads are generally not used during normal operation (i.e., after wafer sort), and thus, may be available for use in communicating with a mobile communication circuitry 204.

For a more particular example, an RFID tag may be provided with a serially loaded test mode register (not shown). The test mode register communicates with test circuitry also included within the tag IC to initiate testing of one or more sections of the IC. Such tags may include a front end processor for processing received radio signals, a signal processor for producing a return signal, and the test circuitry, including the serially loaded test mode register. In addition, the tag may include a mode register that may be loaded via the test pads to select an operational mode for the tag IC, including a normal RF mode and various test modes. It may be possible to write data to the RFID memory while in normal mode using such pads. In addition, or in the alternative, the tag IC may be temporarily placed in one of various test modes to enable a write to memory, and then restored to normal mode while preserving the saved data. Further details concerning the use of test pads to communicate with an RFID device may be found, for example, in U.S. Pat. No. 6,412,086, which is hereby incorporated herein by reference in its entirety.

The invention is not limited, however, to the use of test pads. Dedicated I/O pads and modes may be provided in the RFID device 206 for the purpose of communicating with communications circuit 204. For example, an RFID tag may be provided with a function for enabling or disabling communications, and in particular, data write commands, from external circuitry. An enable/disable function may comprise, for example, a mode register, a switch, or other hardware or software system. Power may be supplied to the RFID device using a suitable power interface in coordination with the enable/disable function. In an embodiment of the invention, power may be supplied to pads for antenna 212 by a battery or other power source for mobile key 202 during interactions with circuit 204.

Circuit 204 may send the external circuit enabler/disabler circuit (not shown) a memory address for RFID device 206 formatted as a write broadcast command. Device 206 decodes the address information sent to it from the external circuit 204, and writes data from circuit 204 to the addressed memory location. One of ordinary skill may provide various interface circuitry for a passive or active RFID chip for receiving power from an external device, and for reading from the RFID memory to the external device. For example, interface circuitry may be provided as described in U.S. Pat. No. 5,874,902, which is hereby incorporated herein by reference in its entirety.

In the alternative, or in addition, circuit 204 may communicate with RFID device 206 via antenna 212 using a wired or wireless transmission to write data to the RFID device memory. For example, circuit 204 may include a module that emulates certain functions of an RFID base station. Yet another alternative is to provide a non-volatile RAM memory or magnetic storage media (not shown) for communications circuitry 204 with a connection via a suitable memory interface to RFID device 206. Data for use by the RFID transponder could be placed in a predetermined shared memory location, and accessed by the RFID device during normal operation.

The antenna 212 of the RFID device may be formed on a printed circuit board in such a way so as to be readily coupled with the interrogating antenna 222 of base station 214. An example of such an antenna configuration is provided by U.S. Pat. No. 5,995,006, which is also incorporated herein by reference in its entirety. Other antenna configurations may also be suitable.

Many mobile telephones and similar device include an display screen that is capable of displaying computer graphics images, for example, photographic or video data. In an embodiment of the invention, such a display screen may be used to display a 2D optical code for optical encoding of any desired information, including but not limited to access codes and the like. In addition to, or in the alternative to providing an access code to a base station using an incorporated RFID device, it should be possible to transmit an access code to an optical reader of an access control device using the display screen. Yet another possibility is to use the wireless circuit 204 to transmit the access code to a local wireless receiver of an access control device.

Figure 3:
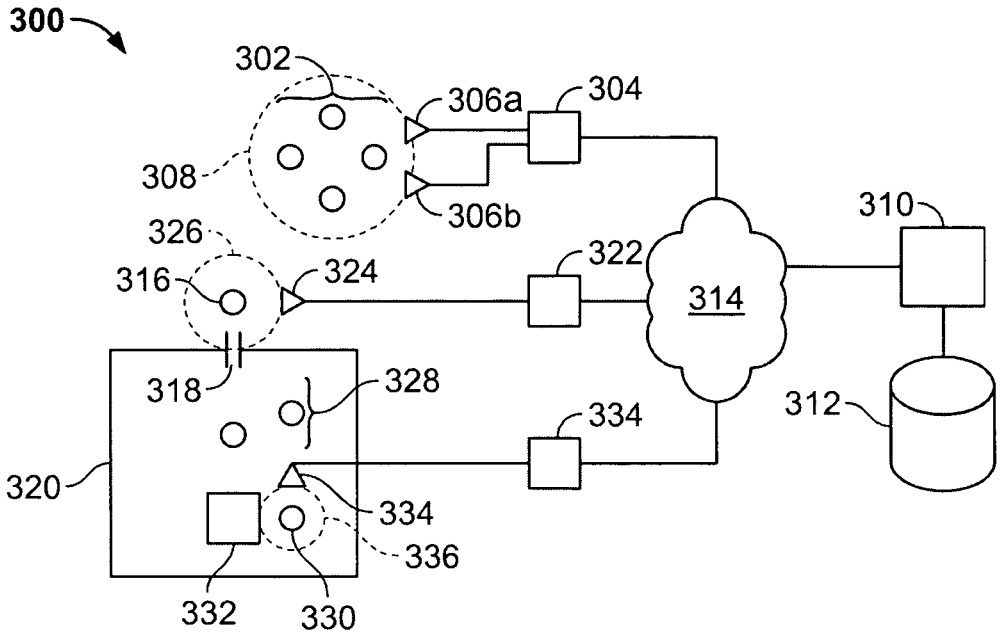
FIG. 3 is a schematic diagram showing the use of multiple interrogating fields for performing different functions with a mobile key.

FIG. 3 shows an exemplary system 300 for communicating with mobile keys using a plurality of different antennas. A base station 304 is disposed to read or write information to multiple mobile keys 302 present in an interrogation field 308 of antennas 306*a*, 306*b*. It is desired to use mobile keys of the same type as present in field 308 for access to area 320 or resource 332. Interrogation field 308 is placed in an area accessible to key holders outside of restricted area 320. It should thus be possible to use base station 304 to authorize or validate mobile keys 302 for later access to restricted area 320 or resource 332. Base station 304 may be connected, such as via a network 314, to a controller 310 and access control database 312.

Restricted area 320 may be provided with one or more gateways 318 through which access to the area is controlled. A second base station 322 may be connected to an antenna 324 providing an interrogation field 326 adjacent or at gateway 318. Base station 322 may read access control data from a mobile key 316 present in interrogation field 326. Station 322 may communicate with controller 310 to validate access control data from mobile key 316 using database 312. If mobile key 316 contains valid access control data, access may be permitted to a key holder of key 316 via access control gate 318. Gate 318 may be operated automatically (e.g., by activating a locking/unlocking mechanism electronically), or using an attendant.

Area 320 may contain various keys 328 that have already entered via gate 318. It may also contain one or more additional resources 332 to be accessed by key holders. For example, resource 332 may comprise a vending machine of any type. Resource 332 may, in the alternative or in addition, be placed outside of area 320. Base station 334 and antenna 334 may be disposed to provide an interrogation field 336 immediately adjacent to an access control zone or point of resource 332. Base station 334 may communicate with a key 330 in interrogation field 336 and with controller 310 to determine authorization for access to resource 332. Interrogation fields 326, 336 may, in addition or in the alternative, be used for other purposes such as tracking location of mobile keys or use of resources. For example, multiple RFID antennas may be located so as to locate a mobile key by proximity to a nearest antenna, or to provide an alert when a key exits a secured area.

Figure 4:
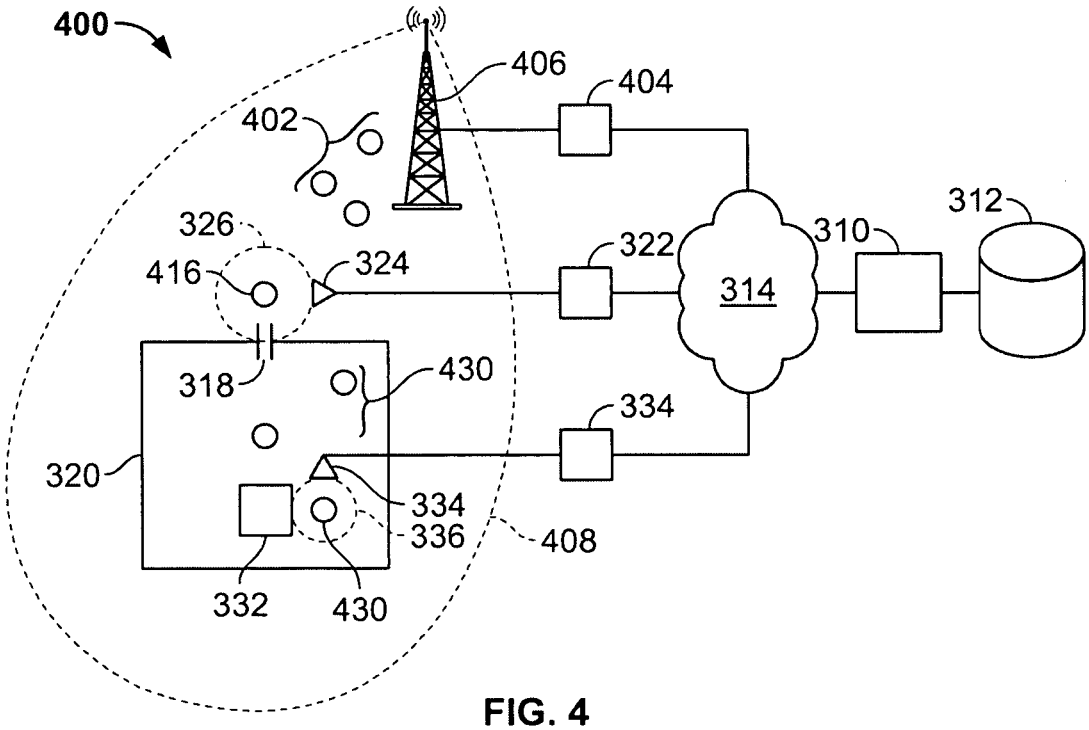
FIG. 4 is a schematic diagram showing multiple interrogating fields and a wireless communications network for performing different functions with a mobile key.

FIG. 4 shows a system 400 similar in many respects to system 300. System 400 may comprise many of the same elements, for example, controller 310, database 312, and so forth, as already shown and described. Keys 402, 416, 430, and 430 correspond to keys 302, 316, 430 and 330 previously described, but with the addition of a wireless communication device as described in connection with FIG. 2. System 400 also comprises wireless communications controller 404 connected to antenna 406 (or antenna network) that provides for wireless communication over an area 408. Area 408 may be geographic in scope, for example, may cover an entire city, region, country, etc., and may encompass both secured area 320 and resource 332. It should be possible to communicate with mobile keys of system 400 anywhere within area 408 for the purpose of requesting and providing (or revoking) access control information. System 400 may otherwise be configured as previously described for system 300.

Figure 5:
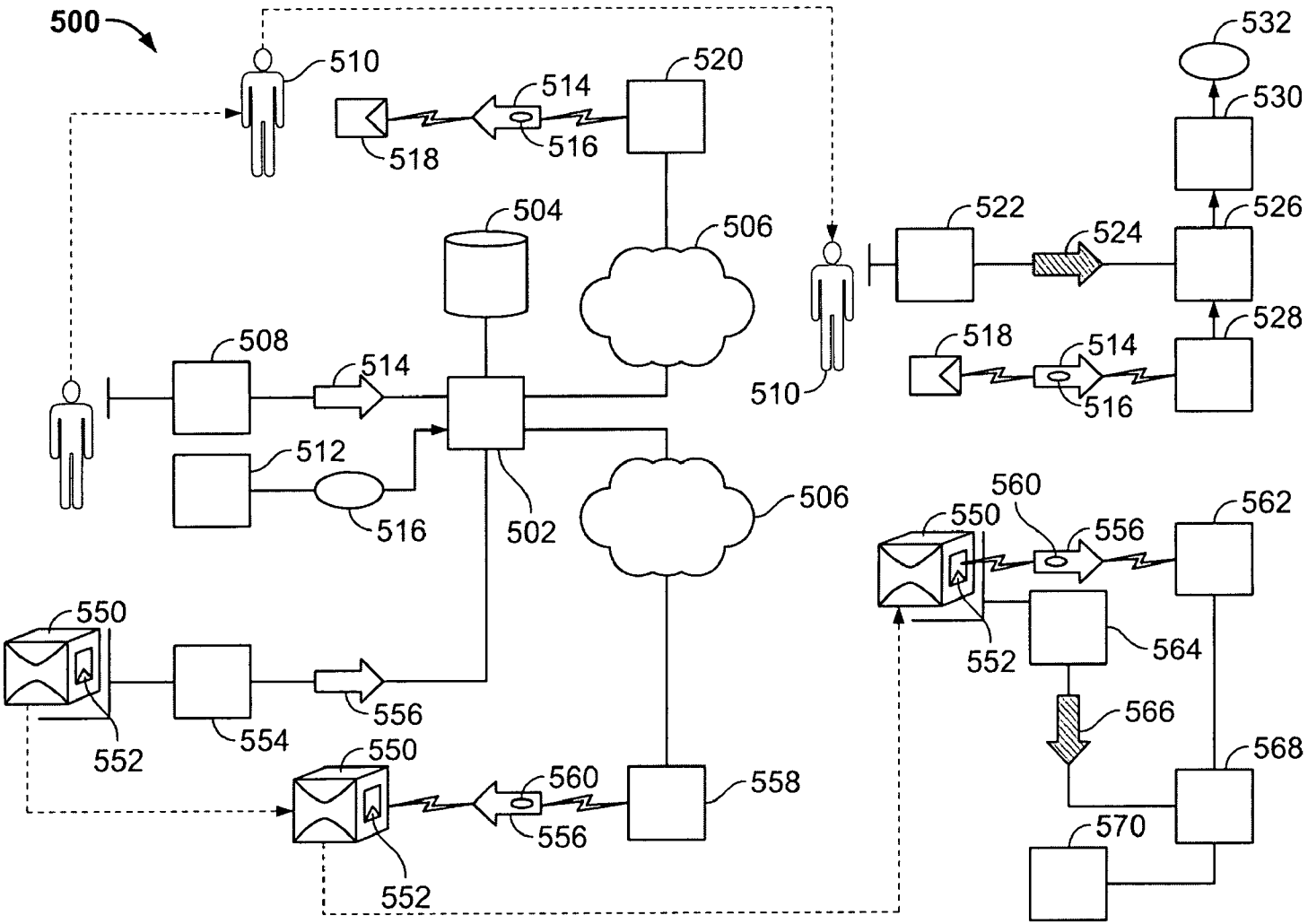
FIG. 5 is a schematic diagram illustrating a system and method for using biometric or physical measurement data with a mobile key.

FIG. 5 shows a system 500 that uses a mobile RFID key 518 to hold identity data 516 and measurement data, such as biometric data 514. In the alternative, system 500 may be adapted to use measurement data 554 for control of package 550. A common controller 502 connected to a database 504 is shown handling both data types. In the alternative, different controllers could be used for different applications or data types.

As configured for biometric data 514, system 500 comprises a biometric input device 508 which collects biometric data from a person 510 using any suitable method as known in the art. Other identifying information 516, such as a name or identification number, may be collected by a second input device 512 in association with biometric data 514. Second input device may comprise any suitable input device, for example, a keyboard, optical card reader, magnetic card reader, or other device. Biometric data 514 may be stored in association with identifying data 516 in a database 504. In the alternative, biometric data may not be stored.

After being collected by devices 508 and 512, the biometric data 514 and identification data 516 may be provided, such as via a network 506, to controller 520 for writing to an RFID key 518 issued to person 510. Controller 520 may comprise an RFID base station communicating via an interrogation field, or any other suitable wireless communication device, such as a mobile telephone. After key 518 has received biometric data 514, person 510 may present it to an RFID base station 528, which reads biometric data 514 and identifying information 516. Person 510 is measured again by second biometric input device 526 to obtain confirming biometric data 524. A controller 530 compares confirming biometric data 524 to stored biometric data 514. A suitable output 532 is provided based on the comparison. For example, if the biometric data matches, identifying information 514 may be provided to another application verifying authorization for access to a secured area or resource. If the biometric data does not match, further information may be provided to a security person or application concerning the match failure.

In the alternative, or in addition, system 500 may be used with other types of identifying information pertaining to the key holder. The identifying information may be stored using the RFID device in the same way as the biometric data. For example, a key holder may be assigned or create her own password or access code. Such information may be collected using an input device 512 or any other input associated with person 510. The password may memorized by person 510 and provided via a suitable input device at an access control device, which compares the supplied password to the encrypted password read from the mobile key 518. If the password matches, the identity of key holder 510 may be considered as verified.

System 500 may also be adapted for use with inanimate objects. Measurement data or any other identifying data 556 may be collected for any object, such as package 550, bearing an RFID tag 552. A package may be placed in a measurement zone of any suitable measuring device 554. For example, a package may be placed on a scale or near a chemical sensor. Measurement data 556 may be provided to an RFID base station 558, which writes the data 556 in association with tracking or identifying information 560 to tag 552. At some later time, the package is measured again using a measurement device 564 to obtain confirming measurement data 566. Base station 562 then reads original measurement data 556 and identification data 560. The measurement data are compared using a controller 568. Comparison data is provided to a suitable output device 570. Identification data 560 may also be provided. Package 550 may then be handled based on the data comparison. For example, if a substantial difference in weight is noticed, the package may be set aside for inspection.

Figure 6:
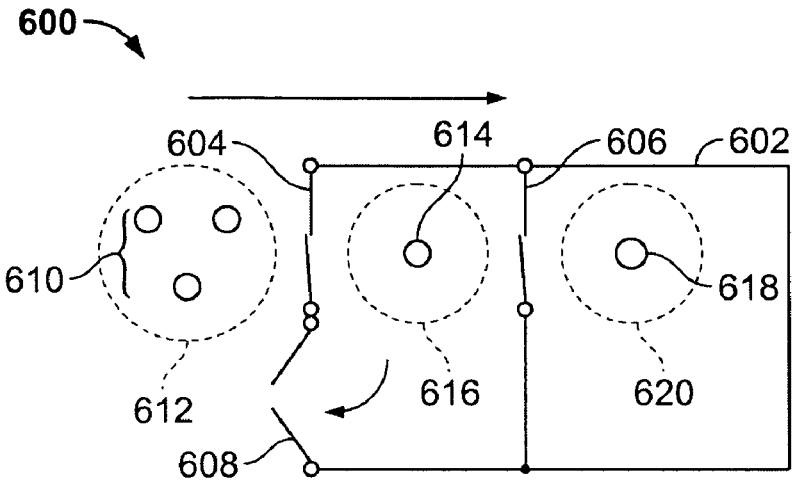
FIG. 6 is a schematic diagram showing a system and method for access control using a mobile key.

FIG. 6 shows an access control apparatus 600 for a restricted area 602. It may be desirable to provide multiple gates 604, 606, 608 to control flow of persons holding RFID keys through a turnstile or other gate, to reduce the likelihood of access by an unauthorized person. Likewise, multiple interrogation fields 612, 616, or 620 may be used to confirm entry by authorized persons only or track movement into or through a restricted area. In the illustrated example, multiple keys 610 may be within an interrogation field 612 requesting access to area 602 via gate 604. It may not be possible to determine with certainty which of these keys actually enters, without using at least one confirming interrogation field 616 disposed on the interior of gate 604.

For example, the authorization status of key 614 may be determined using field 616. If key 614 is not authorized, the key holder may be required to exit via an exit gate 608. If the key is authorized, entry may be permitted into area 602, optionally through a second entry gate 606. Also optionally, interrogation field 620 may be oriented to confirm authorization status of key 618 or to track its progress through area 602. An interior field 620 or 616 may, in addition or in the alternative, be used to track usage history of the key. For example, data may be written to the tag indicating how many times it has been used for entry, the time of entry, and so forth.

In addition, or in the alternative, a mobile key may be provided with a signaling device, such as a visual, audible, or tactile signal. Various suitable devices are known in the art, including but not limited to character display screens of various types, LED's, and mechanical vibrators. Such devices may be powered by a battery on the key and controlled via a connection to an output of the RFID device. When a key is approved for access to a resource, a base station may then send a signal to the RFID device, which in turn activates the signaling device. The key holder may then be informed that the key has been authorized for access.

Multiple RFID Key Configuration

The use of an RFID device to hold and transmit security information presents various technical challenges that are not apparent in prior art keys. One such challenge arises from the ready possibility that more than one mobile key may be in range of a base station for an access control device at any particular time. Operational ranges for current RFID devices are typically on the order of one to six feet, which provides ample interrogation field volume for multiple keys. Therefore, base stations and RFID devices for use with the invention should be configured to handle simultaneous or concurrent presentation of multiple keys quickly and efficiently, without confusing keys or granting access to unauthorized key holders.

One class of suitable RFID devices for these applications may comprise UHF second generation ("G2") passive RFID tags from Intermec Technologies Corporation having offices in Everett, Wash. The G2 chip employs a write-once, read-many (WORM) architecture with both lockable and user-defined non-volatile memory on the order of 128 bits or more. It supports a command protocol for reading and writing to multiple RFID devices present in an interrogation field. Various other RFID devices may also be suitable.

Figure 7:
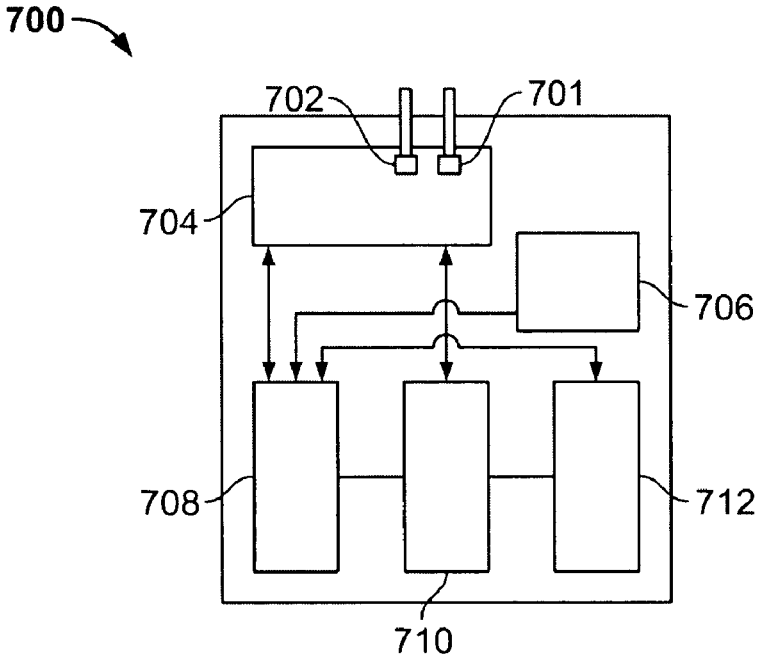
FIG. 7 is a block diagram showing an exemplary RFID device for use with a mobile key.

FIG. 7 is a block diagram of an exemplary G2 chip. Signals enter through antenna pads 701, 702 into RF front end 704, where both tag power and the modulation envelope are recovered. Tag power is regulated and bias voltages are generated in one part of the analog section 708 in conjunction with power capacitor 706. In another part of the analog section 708, the modulation envelope is applied to a clock and data recovery circuit. In case of a valid command, a first part of the input signal serves as a preamble and start delimiter, which is followed by a specific tag command and any additional parameters that the command may require. Valid digital data is processed in the digital section 710 data path under the control of a control module, also in the digital section. If a read or write operation is to be executed, the EEPROM block 712 will be accessed. If data is to be sent from the tag to a base station in response to the command, the digital section sends the output pattern back to the RF front end 704, where an impedance modulation that constitutes backscatter is executed.

RFID digital section 710 includes several state machines that undergo transitions in the course of processing a command. In some cases, the tag state determines how a given command is handled by the tag. An initialization command, for example, can generally be executed whenever the tag is ready to receive a command, regardless of the state of the tag. In comparison, a command to lock a byte of memory will be executed contingent on the outputs of several tag state machines, including a tag major state as elements of tag minor states.

Algorithm for Efficient Identification of Multiple RFID Tags

Various command protocols and command sets may be suitable for use with the G2 chip or other suitable RFID tags. Some exemplary commands, systems and methods for handling multiple tags in an interrogation field are generally described below. It should be appreciated that one of ordinary skill may develop other or additional suitable commands or methods.

Commands may be provided to select or de-select groups of tags in the interrogation field for reading or writing operations. A group may comprise a single tag, or multiple tags. Group operations may make use of a flag bit or bits used to indicate a selection state of tags in the interrogation field. Multiple flags may be set on the same RFID tag, each flag corresponding to a different operation. For example, a first bit set to '1' may indicate selection of a write operation, while a second bit may be used for a write operation, and so forth. Using selection flags, multiple keys may be coordinated with base station operations for an access control device in various ways.

A command may be provided to cause a selected tag or tags to identify itself to the base station. If more than one tag tries to identify itself at the same time, a command (e.g., "FAIL") may be provided to cause retransmission of tag identity according to a predetermined algorithm. The algorithm should be designed to prevent confusion between identities of different tags. One such algorithm is described below. The algorithm assumes use of group selection commands to define all or a subset of tags in the field to participate in the identification protocol, and use of unique acknowledgments back from tags in the group under certain circumstances. Two hardware components are used on the tag: an 8-bit counter and a random one or zero generator.

Initially, a group of tags are moved to the ID state and the 8-bit counter is set to zero. Then, the following sequence is repeated in a loop until all tags in the group are successfully identified:

1) All tags in the ID state and with counter at zero transmit ID. Initially, this encompasses all the selected tags.
2) If more than one tag transmits, the base station receives an erroneous response and sends a "fail" command. Upon receiving the fail command, all tags with a zero counter value (initially, all the tags) reset the value to a random 1 or 0. All tags with a non-zero counter value increment their counter. Tags with a zero counter value retransmit their ID; other tags do not.
3) One of four possibilities now occurs:
   a. More than one tag transmits, causing step 2 to repeat.
   b. No tag retransmits, causing the base station to send a "success" command causing all tags to decrement the counter by one. Tags with a zero counter value retransmit their ID; other tags do not.
   c. A single tag retransmits, causing a handshake with the base station and data operation (e.g., read, write, or both) to occur with the identified tag, and sets a flag exempting it from further identification attempts for the selected group. The base station then sends the success command causing all remaining tags in the group to decrement their counters by one. Tags with a zero counter value retransmit their ID; other tags do not.
   d. Some other error occurs, prompting a retransmission or other recovery attempt, which, if successful leads to step 3(c) and if unsuccessful to step 3(a).

The foregoing loop may be terminated when all the tags have been identified or a persistent failure is encountered. Whether or not all tags have been identified may be determined by comparing the number of issued "success" commands to "fail" commands. If these numbers are equal immediately after an ID is received correctly, this should indicate that all tags in the group have been identified.

The following measures may be taken to ensure robust operation of the algorithm in special cases:

1) Tags entering the interrogation field during an identify operation should have flags set so as to exclude them from the group being handled. After all tags in the current group are identified, the base station can send another group selection command to check for the presence of new tags.
2) A "success" command that does not engender any response may indicate that a selected tag has left the interrogation field without being identified. In such case the identification loop may be terminated, optionally after sending additional success commands.
3) In case of an error in transmission of commands or data, all tags in the group may receive an error. Under some circumstances, this might cause the base station to erroneously believe that all tags have been identified after a "success" command engenders no response. In such case, some number of additional success commands should be transmitted to check for unidentified tags remaining in the group.

Identifying Multiple RFID Tags with Improved Efficiency

RFID tags sometimes lose power while being interrogated and fall out of the applicable identification protocol. When they regain power, and enter the identification protocol loop again, considerable overhead may be spent in re-identifying them. This may reduce efficiency of the identification protocol and diminish the number of tags that can be identified in a given time interval. To increase operational efficiency, it is desirable to avoid unnecessary repetition of the identification protocol due to power loss, without failing to identify all RFID tags within range of a base station.

In an embodiment of the invention, performance is enhanced when identifying or writing to two or more tags, using two commands for selecting specific RFID tags based on certain selection criteria. The criteria for selection can be set based on user requirements. By setting the selection criteria, for example, a user may perform the following operations:

1) selection of any combination of a subset of available flags,
2) selection based on matching flag condition, or
3) selection based on non-matching flag condition.

For example, available flags may comprise a "state_storage" flag and an "write_ok" flag. The state_storage flag may indicate whether or not the tag was in a specific data exchange state prior to losing power, and the write_ok flag may indicate whether or not the last write operation on the RFID non-volatile memory was done with adequate power supply (e.g., whether a good write was done into the EEPROM memory matrix).

An RFID IC device may have the capability of storing a voltage ($V_{STORAGE}$) on a high impedance node, for use in indicating one of three major states—READY, ID and DATA_EXCHANGE—using a state_storage flag. For example, $V_{STORAGE}$ may be charged (i.e., set high) when the tag goes to DATA_EXCHANGE state, and discharged (i.e., set low) when an INITIALIZE command or an appropriate GROUP_SELECT command is issued from the base station. Table I below indicates exemplary values of $V_{STORAGE}$ for different ones of the three tag states.

TABLE I

| TAG STATE | $V_{STORAGE}$ |
|---|---|
| READY | Can be high or low |
| ID | Low |
| DATA_EXCHANGE | High |

$V_{STORAGE}$ is high in the READY state if the tag was previously identified and lost power and went back into the ready state; otherwise, it is low in the READY state.

Various commands may be provided in conjunction with the selection of RFID tags using the selection criteria. For example, two useful commands may comprise:

1) Group select flags—this will move tags in a group from the READY state to the ID state, for example, by setting $V_{STORAGE}$ low;
2) Group unselect flags—this will move tags in a group from the ID to the READY state, for example, by setting $V_{STORAGE}$ high.

Both of the foregoing commands may be configured to operate only if the flags on a tag match specified selection criteria. Generally, other commands in a command set may operate regardless of the flag state. The various fields for group_select_flags for selecting on the write_ok flag and the state_storage flag may be configured as follows:

<preamble><command><bit_mask><data><crc>;

wherein both the bit_mask and the data fields are one byte fields. The bit_mask may be configured to enable selection using flags. Once a bit flag is enabled, the value of the data field may enable selection on flag "high" or "low." For example, if the last two bits of the bit_mask and the data field are used for state_storage and write-ok (Least Significant Bit) in that order then results as indicated in Table II may be obtained.

TABLE II

| bit mask | data | result |
|---|---|---|
| 11 | 11 | will select all tags with state_storage high and write_ok high |
| 11 | 01 | will select all tags with state_storage low and write_ok high |
| 01 | 11 | will select all tags with state_storage high |
| 11 | 10 | will select all tags with state_storage high and write_ok low |

In Table II, only last two bits for each field are shown. To identify tags that have already been identified but subsequently have lost power, RFID tags with state_storage high and write_ok low may be selected. Operations may be performed on these tags only, avoiding unnecessary identification or other operations. Likewise, tags that have not yet been identified may be selected for identification, while excluding tags that have already been identified.

Enhancing RFID Writing Performance

In embodiments of the invention, it may be desirable to write data to an RFID tag of a mobile key using an interrogation field. Write operations typically involve programming to the memory matrix in an EEPROM device, and as a result require considerable time for writing. In embodiments of the invention, a novel way of writing multiple bytes to the EEPROM without modifying internal circuitry may be used. This method may use existing circuit blocks for writing to the EEPROM. As a result, write performance may be improved to be comparable to read performance, providing a substantial performance improvement over prior RFID systems.

Under previous methods, writing to a tag was limited to one byte. Using the method disclosed herein, it should be possible to write to more than one byte. In an embodiment of the invention, commands for writing 1-4 bytes to RFID tags in the field are provided, and wherein the number of bytes to write is selected by a user. For example, two commands for performing multiple write operations may be provided in a command set:

1) write4byte_multiple—this does writes to all tags in the ID state, and
2) write4byte—this does writes to tags if the ID sent out in the command matches the ID of the tag.

Both commands use a start address for the write operation at a valid address boundary (i.e., addresses 0, 4, 8, . . . ). The byte mask field in the command permits selective writing of bytes to the tag. For example, if the first bit of the byte mask is set, then a write operation is done at <start_address>, if the second bit of the byte_mask is set then a write operation is done to <start_address+|> . . . and so on.

An exemplary format for a write4byte_multiple may be provided as follows:

<preamble-sd><command><address><byte_mask><4 byte data field><CRC>.

As may generally be true with other write_multiple commands (i.e., write_broadcast commands), the tag will not send an error signal back if the tag is not in the ID state. In addition, if the start address for the write4byte_multiple is not a valid page boundary (0, 4, 8, etc.), then no write operation will be done and the tag will not send an error signal back.

As known in the art, an EEPROM may provide the capability of writing 4 bytes in the same time frame as a single byte. This functionality is limited, however, to the case when the start address of the four bytes occurs at the page boundary (e.g., starting addresses of 0, 4, 8, 12, . . . ). For example, to perform a 4-byte write at a starting address of 2, there are two prior-art options. According to a first approach, the 4 bytes may be cached in volatile memory and written into each of the page segments as two separate writes (i.e., 2 bytes are written during the first write cycle and 2 bytes are written during the second write cycle). The total amount of time taken for this is the time for two write cycles plus a base station interface operation, for example, 8+8+4=20 ms. In a second approach, the base station performs 4 separate single-byte writes. This may require an elapsed time of, for example, 4×8=32 ms.

The prior art methods may waste time when writing longer data strings. Consider, for example, a case in which 16 bytes are to be written at a start address of 2. If the EEPROM cannot be written across the page boundaries, this would require additional writes at the page boundaries, as follows: two single-byte writes, plus three four-byte writes, plus another two single-byte writes (for example, a total time of 2×8+3×8+2×8=56 ms.) In comparison, if the same 16 bytes can be written across page boundaries, then the total time taken for the same operation may be reduced to 4×12=48 ms.

In an embodiment of the invention, limitations imposed by memory page boundaries are reduced using the concept of a "write mask." The write mask may be configured as a field, e.g., a 4-bit field, signifying which bytes are to be written and which are not to be written, starting from a page boundary. For example, a write mask value of 1011 may be used to indicate that the first byte, third byte and the fourth byte are to be written from the specified start address provided by the base station. With this approach, one, two, three or four bytes may be written using a single four-byte write command. For example, three bytes can be written with a single command whereas to do the same with a prior art approach would require three separate single-byte writes.

A write command may be developed in various formats to make use of a write mask. For example, in an embodiment of the invention, a write command may be formatted as follows:

(<4 byte write command><8 byte tag ID><1 byte start address><1 byte write mask><4 byte write data>). Of the eight bits of the write mask, only the first four are used in this example, and the remaining bits may be disregarded. For writing to a non-sequential address (with a gap of one or two bytes), a write mask should result in faster writes as noted above. Greater efficiencies should also be realized in many circumstances when writing across page boundaries.

Preserving a State of an RFID Tag on a Mobile Key

A passive RFID tag such as may be used with a mobile key is solely powered from the RF field emission from the base station antenna. Due to reflections from walls, floors and ceilings, there may be locations in range of the basestation where the field strength goes to zero or becomes very low. This phenomena, called multipathing, may be compounded when the basestation uses a frequency-hopping RF field pattern, where the zero's get distributed to multiple locations. In applications where the RFID tag is expected to maintain its state after it is powered, the presence of a zero at the tag locations depowers the tag and destroys state information stored in the tag. This may cause protocols that identify the presence of multiple tags in the field to be less efficient and create delays in fully identifying all the tags.

Therefore, in an embodiment of the invention, a mobile key incorporates an RFID tag with one or more "state preservation cells," each capable of preserving a bit value through a temporary power loss. When power is restored to the RFID tag after a power loss, its state information immediately prior to losing power is recovered from the state preservation cells.

Figure 8:
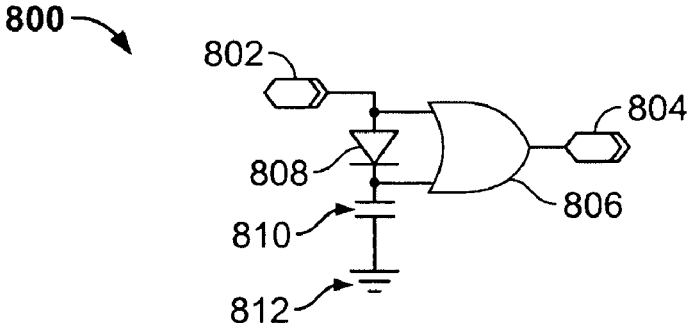
FIG. 8 is a circuit diagram showing an exemplary circuit element for maintaining a current state of an RFID tag.

A exemplary embodiment of a state preservation cell 800 is shown in FIG. 8. The voltage on the capacitor 810 is a mirror value of input 802, less a minor diode drop caused by diode 808. An opposite terminal of capacitor 810 is connected to a ground 812. A zero or low input at 802 results in a zero at output 804 because both inputs to OR gate 806 are zero. Likewise, a "1" or high input at input 802 results in a 1 at output 804. When the RFID tag experiences a power loss, input 802 drops low, but the capacitor 810 continues to hold the original input charge. The input state (e.g., 1 or 0) will be restored at the output 804 through OR gate 806 for as long as the capacitor 810 remains sufficiently charged. For the above implementation, the value of output 804 should be latched onto input 802 (not shown) when the tag is powered.

The duration for which the state preservation cell can preserve the state information may be determined primarily by leakage on parasitic elements. The preservation cell should hold its condition much longer than anticipated power pauses between frequency hops, such as for a substantial number of frequency hops. For example, given a pause time of about fifty milliseconds and frequency-hop pulse time of about 300-400 milliseconds, a preservation cell should hold the state condition for at least about four seconds. A further description of frequency hopping may be found in U.S. Pat. No. 5,850,181, which is hereby incorporated herein by reference, in its entirety.

In an embodiment of the invention consistent with the foregoing methods for multi-tag identification and writing, a state preservation cell may be set when the tag goes into a DATA_EXCHANGE state. Thus, the preservation cell may be used to unselect the tag, so that it does not respond to a subsequent multi-tag protocol command to identify itself.

Methods for Using a Mobile Key with RFID Tag

Figure 9:
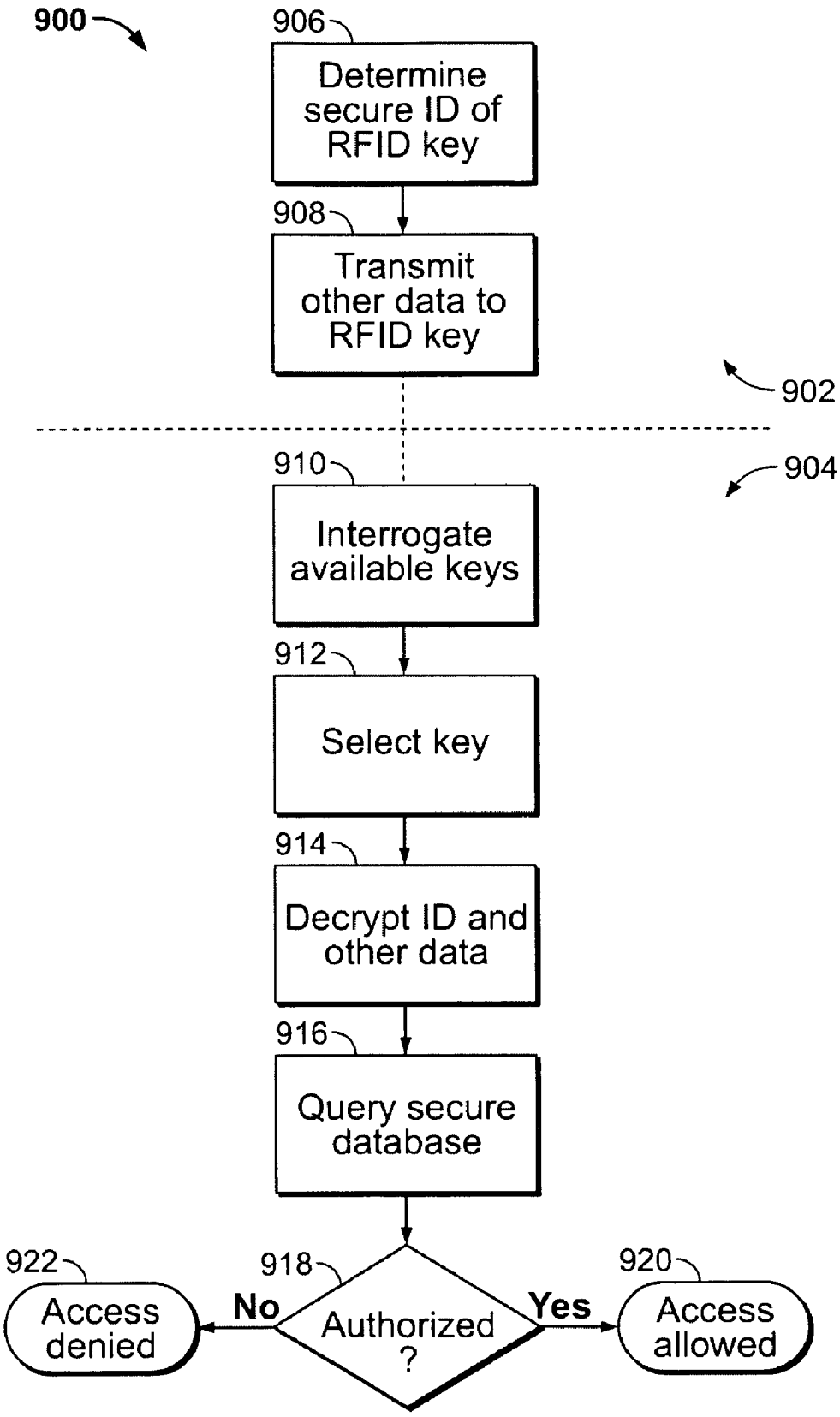
FIG. 9 is a flow chart showing exemplary steps of a method according for access control using a supplied access code.

FIG. 9 shows exemplary steps of a method 900 for using a mobile key and system as described herein for access control. Steps 902 concern providing a mobile key with security information, and steps 904 concern use of the mobile key to gain access to a resource through an access control device. At step 906, a secure ID of a mobile key comprising an RFID tag is determined. Step 906 may be initiated, for example, when a holder of a mobile key anticipates a need for future access to a resource. For example, step 906 may be performed when a new security key is issued to a user, when it is renewed, or when it is used to purchase or otherwise obtain temporally-limited access to a resource.

In an embodiment of the invention, the secure ID comprises identifying information maintained in a memory of an RFID device. It may be determined by interrogating the RFID device, as described above in connection with FIG. 1. In alternative embodiments, the ID may be obtained via a wireless communication network as described above in connection with FIG. 2. The secure ID may be associated with other components of the mobile key. For example, for a key comprising a mobile telephone, the secure ID may comprise the telephone number, optionally in association with a passcode.

At step 908, data in addition to the secure ID is transmitted to the mobile key, in either encrypted or unencrypted form. Such data may include, for example, an access code for providing access to a specific resource, optionally for a limited duration of time. Other data may also include account balance data or any other desired information.

At step 910, the mobile key is presented to an access control device of the desired resource. An RFID base station interrogates the keys within range of its antennas or antennas, either continuously or in response to other input. At step 912, at least one of the keys presented in the interrogation field of the RFID base station is selected for security confirmation. For example, the base station may select a key that is in closest proximity to a gateway. A stepwise approach may also be used, as described above in connection with FIG. 6. In the alternative, keys may be selected randomly, and an alarm sounded if an unauthorized key (as determined later at step 918) is presented.

At step 914, the secure ID and other data present in the memory of the RFID is read by the base station. If necessary, the ID and other data are decrypted. At step 916, a suitable system control, either integrated with the base station or in communication with it, queries a secure database to determine the authorization status for the information read from the mobile key. For example, a database may be queried for an access code read from the RFID memory. If the access code is present in the database and, if necessary, marked as valid for access to the resource, then at step 918 the key may be deemed authorized. If authorized, the key holder may be allowed access to the resource at step 920. If not authorized, access may be denied at step 922.

More sophisticated authorization schemes than described above may be used without departing from method 900. All of these, however, should involve checking with a database of some sort to determine an authorization status at an access control device. Method 900 is therefore consistent with a two-part approach. In the first part, a code is read from and optionally, written to an RFID memory. Authorization rights associated with the code are stored in a database. Later, when the key is presented for access, the database is consulted to confirm the access rights for the presented key.

Figure 10:
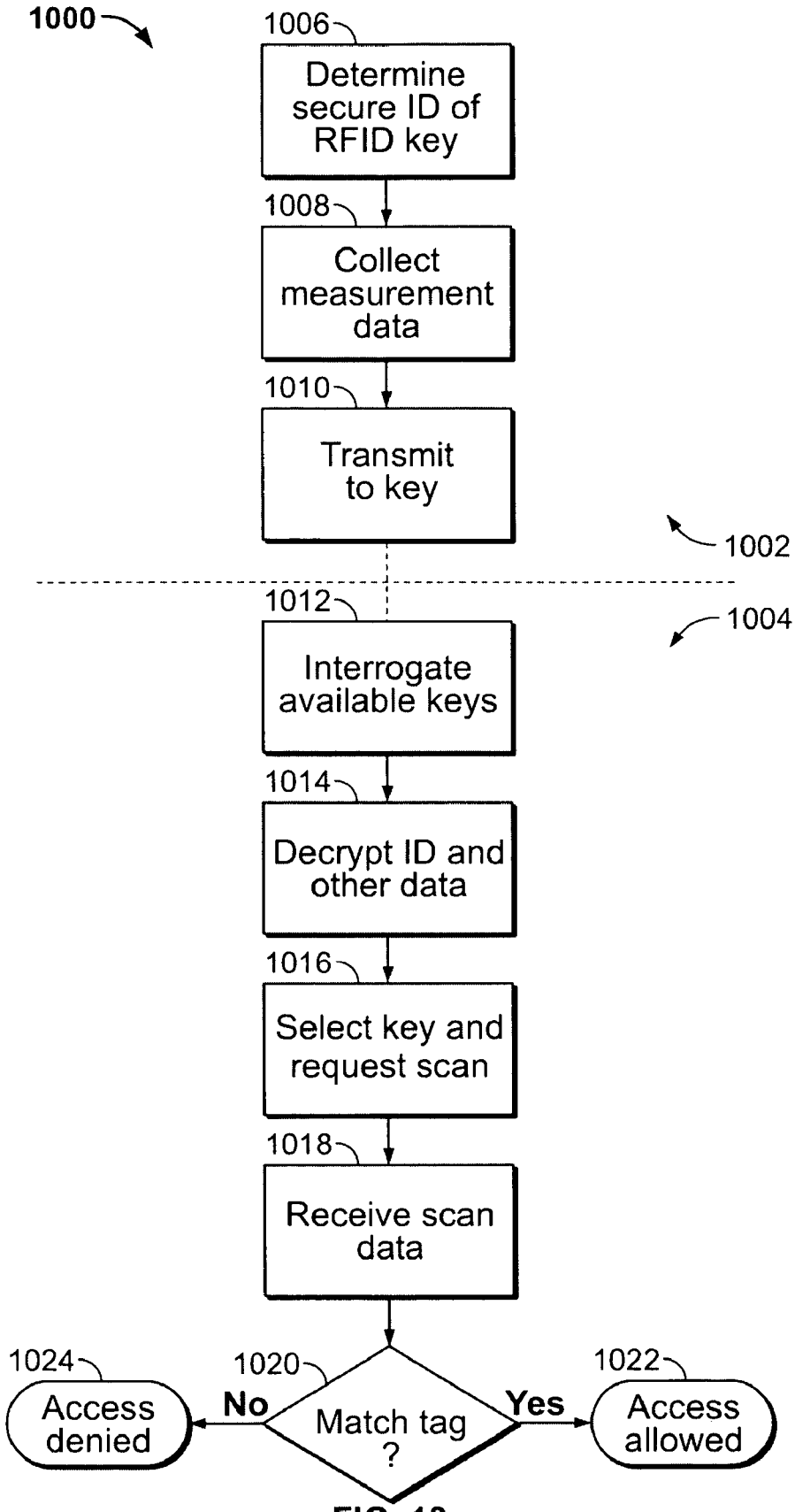
FIG. 10 is a flow chart showing exemplary steps of a method for using biometric data with a mobile key.

It may sometimes be desirable to make use of a mobile key in a way that does not require the use of a secure database. FIG. 10 shows exemplary steps of a method 1000 for making use of a mobile key using at least partially self-sufficient data in the key itself. Method 1000 may be useful for confirming the identity or physical state of a person, animal, or physical object. Steps 1002 concern collection and storage of physical data in a mobile key. Steps 1004 concern presentation of the key to gain access to a protected resource.

At step 1006, a secure ID of the mobile key is determined. Identifying information may be read from the mobile key, stored in the mobile key, or both. The information may be stored in a memory of the mobile key that is accessible to an RFID device of the key. The information should be encrypted. Step 1006 may be initiated, for example, by a request to collect physical data for storage on a key. For example, a key holder may present the key to a biometric scanning machine or other measurement device.

At step 1008, appropriate measurement data is collected. The measurement data may be collected in response to step 1006, or independently of it. In an embodiment of the invention, any useful biometric data, for example, fingerprint, retinal patterns, genetic information, or any other useful data is collected by any suitable method. Such data need not be collected by a single device, or at a single time. In embodiments of the invention, biometric or other data is gathered by multiple devices or at multiple times.

At step 1010, measurement data is transmitted to the key. This may be done using an RFID base station or other suitable communication method. For example, for a mobile key incorporating a wireless communication telephone or other communication device, the wireless network for the communication device may be used.

At step 1012, one or more keys are interrogated by an RFID base station. An identifier for the key and associated physical data are read, and if necessary decrypted at step 1014. At step 1016, confirming measurement data is requested for a selected key. A request may be communicated to the key holder or bearer using any suitable method that results in the person or other physical thing being placed in the measurement zone of a suitable measurement device. For example, if the physical data comprises fingerprint data, the key holder may be instructed to place a digit or digits on a fingerprint scanning machine. If the key bearer is not a person, the object or animal may be placed in a measurement zone using a material handling apparatus. For example, a package may be placed on a scale.

At step 1018, data is received by a suitable system controller from the measurement apparatus. At step 1020, the confirming measurement data received at step 1018 is compared to the stored data received at step 1014. If the data match, the identity of the key holder may be deemed verified. Access may be permitted at step 1022 if the identity is confirmed. Likewise, access may be denied at step 1024 if the identity cannot be confirmed. Method 1000 may, in the alternative, be used to track changes in physical measurement data for purposes other than access control. For such applications, differences in measurement data may be reported for use as otherwise desired.

Having thus described a preferred embodiment of a mobile key with a read/write RFID device, and methods for using it, it should be apparent to those skilled in the art that certain advantages of the within system have been achieved. It should also be appreciated that various modifications, adaptations, and alternative embodiments thereof may be made within the scope and spirit of the present invention. For example, an on-chip interface for receiving the access information from the cell phone circuitry could utilize an EEPROM serial interface integrated in the RFID chip, for writing the access information directly to the chip EEPROM. The invention is defined by the following claims.

What is claimed is:

1. A method for securing access to a resource, comprising:

providing an RFID interrogation field comprising a selection condition;

detecting a plurality of mobile keys in the interrogation field, each one of the plurality of mobile keys comprising an RFID device connected to a memory, the memory holding an access code and a selection flag that matches the selection condition;

selecting a first mobile key from the plurality of mobile keys, the first mobile key comprising a first RFID device connected to a first memory, the first memory holding a first access code;

communicating with the first RFID device of the first mobile key to receive the first access code; and determining an authorization status of the first mobile key based on the first access code.

2. The method of claim 1, further comprising transmitting the first access code to the first mobile key for holding in the first memory.

3. The method of claim 2, wherein the transmitting step further comprises transmitting the first access code to a wireless communications device connected to the first memory, the wireless communication device separate from the first RFID device of the first mobile key.

4. The method of claim 3, wherein the transmitting step further comprises using a cellular telephone network to transmit the first access code, wherein the wireless communications device comprises a cellular telephone.

5. The method of claim 2, wherein the transmitting step further comprises wirelessly transmitting the first access code using the first RFID device of the first mobile key.

6. The method of claim 2, further comprising encrypting the first access code before the transmitting step.

7. The method of claim 6, further comprising decrypting the first access code after the communicating step.

8. The method of claim 1, wherein the first access code comprises a secure identification code assigned to the first mobile key.

9. The method of claim 1, wherein the communicating step further comprises receiving physical measurement data pertaining to an item associated with the first mobile key from the first memory.

10. The method of claim 9, wherein the determining step further comprises determining the authorization status by comparing the physical measurement data from the first memory to second physical measurement data for the item from a measuring device.

11. The method of claim 1, wherein the communicating step further comprises receiving biometric data pertaining to a person bearing the first mobile key from the first memory.

12. The method of claim 11, wherein the determining step further comprises determining the authorization status by comparing the biometric data from the first memory to second biometric data for the person from a biometric data input device.

13. The method of claim 1, wherein the communicating step further comprises receiving an account balance from the first memory, and the determining step further comprises determining the authorization status based on the account balance.

14. The method of claim 13, further comprising debiting the account balance, and transmitting the debited account balance to the first mobile key for holding in the first memory.

15. The method of claim 1, wherein the determining step further comprises determining the authorization status based on a time that the first access code is received from the first mobile key.

16. The method of claim 1, wherein the determining step further comprises determining the authorization status based on a comparison of the first access code to information received from a secure database.

17. The method of claim 1, further comprising activating a signaling device on the first mobile key based on the authorization status.

18. The method of claim 1, further comprising admitting a bearer of the first mobile key to a secured area based on the authorization status, and communicating a second time with the first RFID device after the admitting step to confirm the authorization status of the first mobile key.

19. The method of claim 18, further comprising communicating a second time with the first RFID device after the admitting step to revise the authorization status of the first mobile key.

20. The method of claim 1, wherein the determining step further comprises determining a location of the first mobile key by proximity to a nearest antenna for the RFID interrogating field.

21. The method of claim 1, wherein the step of selecting a first mobile key further comprises:

receiving identification information from at least one of the plurality of mobile keys; and transmitting a fail command if identification information is received from more than one of the plurality of mobile keys.

22. The method of claim 1, further comprising:

selecting a second mobile key from the plurality of mobile keys, the second mobile key comprising a second RFID device connected to a second memory, the second memory holding a second access code;

communicating with the second RFID device of the second mobile key to receive the second access code; and determining an authorization status of the second mobile key based on the second access code.

23. The method of claim 22, wherein the step of selecting a second mobile key comprises selecting the second mobile key at a time when the first mobile key is not selected.

24. The method of claim 22, wherein the second access code comprises a secure identification code assigned to the second mobile key.

25. The method of claim 22, wherein the communicating step further comprises receiving physical measurement data pertaining to an item associated with the second mobile key from the second memory.

26. The method of claim 22, wherein the communicating step further comprises receiving biometric data pertaining to a person bearing the second mobile key from the second memory.

27. The method of claim 22, wherein the communicating step further comprises receiving an account balance from the second memory, and the determining step further comprises determining the authorization status based on the account balance.

28. An apparatus for controlling access to a resource, comprising:

an RFID base station disposed to provide an RFID interrogation field;

access control hardware configured to control access to a resource depending on an authorization status of a user; and a controller operably associated with the access control hardware and with the RFID base station, the controller operably associated with a memory holding program instructions for:

providing an RFID interrogation field comprising a selection condition;

detecting a plurality of mobile keys in the interrogation field, each one of the plurality of mobile keys comprising an RFID device and holding an access code and a selection flag that matches the selection condition;

selecting a first mobile key from the plurality of mobile keys, the first mobile key comprising a first RFID device and holding a first access code;

communicating with the first RFID device of the first mobile key to receive the first access code; and determining an authorization status of the first mobile key based on the first access code.

29. The apparatus of claim 28, wherein the memory further comprises program instructions for decrypting the first access code.

30. The apparatus of claim 28, wherein the memory further comprises program instructions for receiving physical measurement data pertaining to an item associated with the first mobile key.

31. The apparatus of claim 30, wherein the memory further comprises program instructions for determining the authorization status by comparing the physical measurement data from the first mobile key to second physical measurement data for the item from a measuring device.

32. The apparatus of claim 28, wherein the memory further comprises program instructions for receiving biometric data pertaining to a bearer of the first mobile key from the first mobile key.

33. The apparatus of claim 32, wherein the memory further comprises program instructions for determining the authorization status by comparing the biometric data from the first mobile key to second biometric data for the item from a measuring device.

34. The apparatus of claim 28, wherein the memory further comprises program instructions for receiving an account balance from the first mobile key, and further determining the authorization status based on the account balance.

35. The apparatus of claim 34, wherein the memory further comprises program instructions for debiting the account balance, and transmitting the debited account balance to the first mobile key.

36. The apparatus of claim 28, wherein the memory further comprises program instructions for further determining the authorization status based on a time that the first access code is received from the first mobile key.

37. The apparatus of claim 28, wherein the memory further comprises program instructions for determining the authorization status based on a comparison of the first access code to information received from a secure database.

38. The apparatus of claim 28, wherein the memory further comprises program instructions for activating a signaling device on the first mobile key based on the authorization status.

39. The apparatus of claim 38, wherein the memory further comprises program instructions for communicating a second time with the RFID device to confirm the authorization status of the first mobile key.

40. The apparatus of claim 28, wherein the memory further comprises program instructions for determining a location of the first mobile key by proximity to a nearest antenna for the RFID interrogating field.

41. The method of claim 28, wherein the memory further comprises program instructions for:

receiving identification information from at least one of the plurality of mobile keys, wherein the identification information includes, at least in part, access code information; and transmitting a fail command if identification information is received from more than one of the plurality of mobile keys.

42. The method of claim 28, wherein the memory further comprises program instructions for:

selecting a first mobile key from the plurality of mobile keys, the first mobile key comprising a first RFID device and holding a plurality of access codes; and communicating with the first RFID device of the first mobile key to receive at least one of the plurality of access codes; and determining an authorization status of the first mobile key based on the at least one of the plurality of access codes.

43. The apparatus of claim 28, wherein the memory further comprises program instructions for:

selecting a second mobile key from the identified mobile keys, the second mobile key comprising a second RFID and holding a second access code;

communicating with the second RFID device of the second mobile key to receive the second access code; and determining an authorization status of the second mobile key based on the second access code.

44. A method for securing access to a resource, comprising:

providing an RFID interrogation field comprising a selection condition;

detecting a plurality of mobile keys in the interrogation field, each one of the plurality of mobile keys comprising an RFID device connected to a memory, the memory holding an access code and a selection flap that matches the selection condition;

selecting a first mobile key from the plurality of mobile keys, the first mobile key comprising a first RFID device connected to a first memory, the first memory holding a first access code, comprising receiving identification information from a first portion of the plurality of mobile keys, wherein (1) each one of the first portion of the plurality of mobile keys includes a counter that is set to zero and (2) each one of a second portion of the plurality of mobile keys includes a counter that is set to an integer that is greater than zero; and transmitting a fail command if identification information is received from more than one of the plurality of mobile keys, the fail command being used by (1) each one of the first portion of the plurality of mobile keys to set their counter to a random number and (2) each one of the second portion of the plurality of mobile keys to increment their counter, wherein the random number is selected from a number consisting of zero and one;

communicating with the first RFID device of the first mobile key to receive the first access code; and determining an authorization status of the first mobile key based on the first access code.

* * * * *